US009856818B2

(12) United States Patent
Quinton et al.

(10) Patent No.: US 9,856,818 B2
(45) Date of Patent: Jan. 2, 2018

(54) STABILIZED ENGINE CASTING CORE ASSEMBLY, METHOD FOR MAKING AN ENGINE BODY, AND ENGINE BODY FORMED THEREBY

(71) Applicant: Cummins Inc., Columbus, IN (US)

(72) Inventors: Aaron S. Quinton, Columbus, IN (US); John Jerl Purcell, III, Louisa, VA (US); Nathaniel P. Hassall, Sowerby (GB)

(73) Assignee: Cummins Inc., Columbus, IN (US)

( * ) Notice: Subject to any disclaimer, the term of this patent is extended or adjusted under 35 U.S.C. 154(b) by 57 days.

(21) Appl. No.: 14/646,348

(22) PCT Filed: Nov. 26, 2013

(86) PCT No.: PCT/US2013/071955
§ 371 (c)(1),
(2) Date: May 20, 2015

(87) PCT Pub. No.: WO2014/085430
PCT Pub. Date: Jun. 5, 2014

(65) Prior Publication Data

US 2015/0315994 A1 Nov. 5, 2015

Related U.S. Application Data

(60) Provisional application No. 61/730,398, filed on Nov. 27, 2012.

(51) Int. Cl.
*B22D 29/00* (2006.01)
*F02F 1/10* (2006.01)
(Continued)

(52) U.S. Cl.
CPC ..... *F02F 1/10* (2013.01); *B22C 9/10* (2013.01); *B22D 25/02* (2013.01); *B22D 29/001* (2013.01);
(Continued)

(58) Field of Classification Search
CPC ..... F02F 1/10; F02F 7/0007; F02F 7/0095; B22D 29/002; B22D 29/001; B22D 25/02; B22C 9/10; Y10T 29/49274
See application file for complete search history.

(56) References Cited

U.S. PATENT DOCUMENTS 3,684,000 A 8/1972 Van Deberg
3,965,677 A 6/1976 Goto et al.
(Continued)

FOREIGN PATENT DOCUMENTS

CN 101003076 7/2007
CN 201832953 U 5/2011
(Continued)

OTHER PUBLICATIONS

First Office Action for Chinese Patent Application No. 20130060691.8, dated Mar. 21, 2016, 6 pages.
(Continued)

*Primary Examiner* — Ryan J Walters
(74) *Attorney, Agent, or Firm* — Foley & Lardner LLP

(57) ABSTRACT

An engine block assembly and method manufacturing an engine block assembly and related components. A casted engine block assembly includes a cylinder block portion. The cylinder block portion includes a plurality of cylinder block openings disposed therein, a cylinder block flange portion positioned at a top of the cylinder block portion and a cylinder block crankcase portion disposed at a base of the cylinder block. The cylinder block flange portion is configured for coupling the cylinder block to a cylinder head. The
(Continued)

cylinder block portion includes a plurality of cylinder block walls extending between the cylinder block flange portion and the cylinder block crankcase portion and positioned about the plurality of cylinder block openings. The cylinder block walls house a plurality of internal channels. The plurality of cylinder block walls are void of enclosed openings extending through at least one of the cylinder block walls in the plurality of cylinder block walls.

17 Claims, 7 Drawing Sheets

(51) Int. Cl.
*B22D 25/02* (2006.01)
*B22C 9/10* (2006.01)
*F02F 7/00* (2006.01)

(52) U.S. Cl.
CPC ..... *B22D 29/002* (2013.01); *F02F 7/0007* (2013.01); *F02F 7/0095* (2013.01); *Y10T 29/49274* (2015.01)

(56) References Cited

U.S. PATENT DOCUMENTS

| | | | | |
|---|---|---|---|---|
| 4,237,847 | A * | 12/1980 | Baugh | F02F 1/163 123/193.2 |
| 4,754,798 | A * | 7/1988 | Chandley | B22C 9/043 164/35 |
| 5,069,192 | A * | 12/1991 | Matsumoto | F01M 13/02 123/41.86 |
| 6,205,959 | B1 | 3/2001 | Smetan et al. | |
| 7,013,948 | B1 | 3/2006 | Grebe et al. | |
| 7,225,786 | B2 * | 6/2007 | Kim | B22C 9/103 123/195 R |
| 7,621,250 | B2 | 11/2009 | Iizumi et al. | |
| 2003/0172884 | A1 | 9/2003 | Laufenberg et al. | |
| 2004/0118364 | A1 | 6/2004 | Hughes et al. | |
| 2007/0163744 | A1 | 7/2007 | Douro et al. | |
| 2010/0199634 | A1 | 8/2010 | Heaton | |
| 2013/0104530 | A1 | 5/2013 | Geveci | |

FOREIGN PATENT DOCUMENTS

| | | |
|---|---|---|
| DE | 203 14 369 U1 | 6/2004 |
| DE | 10 2014 009 739 A1 | 1/2015 |
| EP | 1 336 746 | 8/2003 |
| WO | WO-2008/059330 | 5/2008 |
| WO | WO 2008/059330 A1 | 5/2008 |
| WO | WO 2012/102666 A1 | 8/2012 |

OTHER PUBLICATIONS

The International Search Report and Written Opinion of the International Searching Authority issued in PCT/US2013/071955, dated Jun. 18, 2014.

International Search Report and Written Opinion Issued for PCT Application No. PCT/US2015/060913, dated Jan. 22, 2016,10 pages.

* cited by examiner

STABILIZED ENGINE CASTING CORE ASSEMBLY, METHOD FOR MAKING AN ENGINE BODY, AND ENGINE BODY FORMED THEREBY

CROSS REFERENCE TO RELATED APPLICATIONS

The present application is a U.S. National Stage of PCT Application No. PCT/US2013/071955, filed Nov. 26, 2013, which claims priority to U.S. Provisional Application No. 61/730,398, filed Nov. 27, 2012 and entitled "STABILIZED ENGINE CASTING CORE ASSEMBLY, METHOD FOR MAKING AN ENGINE BODY, AND ENGINE BODY FORMED THEREBY," which application is the contents of which are incorporated herein by reference in their entirety.

TECHNICAL FIELD

The present application relates generally to a core assembly for forming an engine block, the method for forming the engine block, and the resulting engine block and related components formed thereby.

BACKGROUND

Engine block cores and engine cylinder head core designs generally include "prints" or protrusions extending outwardly or externally from the side and/or end of the cores. The prints may be used to stabilize the cores and enable clean-out of cores, such as coolant and lubrication cores. However, these prints generally extend through the side and/or end walls of the engine block formed and the resulting openings produced in the external surfaces of the casted engine block reduces the structural rigidity of the block. Additionally, the external openings created by the penetrations extending the wall of the engine block generally require machining and plugging during engine manufacturing, thereby adding cost and time to the manufacturing process.

SUMMARY

Various embodiments provide an engine block and methods of manufacturing an engine block and related components.

According to various embodiments, a method of casting an engine block is provided. The method includes providing a mold for the engine block. The mold includes a plurality of cylinder barrel core sections. Each cylinder barrel core section of the plurality of cylinder barrel core sections includes at least one curved protrusion protruding radially outward from a cylinder barrel core section wall and extending about at least a portion of a circumferential portion of the cylinder barrel core section. The at least one curved protrusion includes one or more core prints extending therefrom. The one or more core prints connect the at least one curved protrusion from which the one or more core prints extends to an adjacent cylinder barrel core section in the plurality of cylinder barrel core sections. A molten material is casted in the mold and about the plurality of cylinder barrel core sections such that an engine block is formed having a plurality of cylinder block walls extending between a cylinder block flange portion and a cylinder block crankcase portion. The cylinder block walls are positioned about a plurality of cylinder block openings. The plurality of cylinder block walls house at least one internal channel extending about at least a portion of a circumferential portion of each cylinder block opening. The at least one internal channel is formed by the at least one curved protrusions and the one or more core prints.

The method may further include removing the plurality of cylinder barrel core sections from the engine block before any machining (for example, drilling) of the engine block. In particular embodiments, the plurality of cylinder barrel core sections are removed from the engine block via a washing fluid. A coolant fluid may be flowed through the at least one internal channel extending about at least a portion of a circumferential portion of each cylinder block opening without machining through cylinder block walls into the at least one internal channel. A lubricating fluid may be flowed through the at least one internal channel extending about at least a portion of a circumferential portion of each cylinder block opening without machining through cylinder block walls into the at least one internal channel. A cylinder liner may be inserted into each cylinder block opening in the plurality of cylinder block openings. The at least one of the cylinder barrel core sections includes at least one core print extending out from at least one cylinder barrel core section in the plurality of cylinder barrel core sections such that a corresponding opening is formed at least one of the cylinder block walls in the plurality of cylinder block walls extending between the cylinder block flange portion and a cylinder block crankcase portion. In particular embodiments, the method includes positioning at least a portion of a functional engine component in the corresponding opening. In particular embodiments, the method includes washing the at least one internal channel extending about at least a portion of a circumferential portion of each cylinder block opening via washing fluid entering the engine block via the corresponding opening. Other various embodiments provide a method of casting an engine block that includes casting a cylinder block portion including a plurality of cylinder block openings disposed therein. The method also includes casting a cylinder block flange portion positioned at a top of the cylinder block portion. The cylinder block flange portion is configured for coupling the cylinder block to a cylinder head. The method further includes casting a cylinder block crankcase portion disposed at a base of the cylinder block. The cylinder block portion is casted to include a plurality of cylinder block walls extending between the cylinder block flange portion and the cylinder block crankcase portion and positioned about the plurality of cylinder block openings. The cylinder block portion is also casted to include at least one internal channel extending about at least a portion of a circumferential portion of each cylinder block opening within the plurality of cylinder block walls. The at least one internal channel is formed by a plurality of core sections having one or more core prints connecting the core sections. The at least one internal channel may be washed without machining the block and causing coolant to flowing within the at least one internal channel without machining.

Other various particular embodiments provide a casted engine block that includes a cylinder block portion including a plurality of cylinder block openings disposed therein. The engine block also includes a cylinder block flange portion positioned at a top of the cylinder block portion, the cylinder block flange portion configured for coupling the cylinder block to a cylinder head. A cylinder block crankcase portion disposed at a base of the cylinder block. The cylinder block portion includes a plurality of cylinder block walls extending between the cylinder block flange portion and the cylinder block crankcase portion. The cylinder block walls are positioned about the plurality of cylinder block openings. The plurality of cylinder block walls house at least one internal channel extending about at least a portion of a circumferential portion of each cylinder block opening. The at least one internal channel is formed by a plurality of core sections having one or more core prints connecting the core sections. The at least one channel is an un-machined channel. In particular embodiments, the at least one channel is an undrilled channel.

In particular embodiments, a casted engine block assembly includes a cylinder block portion including a plurality of cylinder block openings disposed therein, a cylinder block flange portion positioned at a top of the cylinder block portion and a cylinder block crankcase portion disposed at a base of the cylinder block. The cylinder block flange portion is configured for coupling the cylinder block to a cylinder head. The cylinder block portion includes a plurality of cylinder block walls extending between the cylinder block flange portion and the cylinder block crankcase portion and positioned about the plurality of cylinder block openings. The plurality of cylinder block walls house a plurality of internal channels. The plurality of cylinder block walls are void of enclosed openings extending through at least one of the cylinder block walls in the plurality of cylinder block walls.

In particular embodiments, the casted engine block assembly also includes a first plurality of fluid channels extending in a direction having a vertical component from the cylinder head flange portion to the crankcase portion and positioned within the plurality of cylinder walls. The casted engine block assembly may also include a second plurality of fluid channels extending in a direction having a horizontal component between the first plurality of channels such each fluid channel in the first plurality of fluid channels is in fluid communication, in accordance with particular embodiments. The plurality of cylinder block openings in the casted engine block are disposed in a single line in a particular embodiment. In particular embodiments, the plurality of cylinder block openings are disposed in a plurality of lines. The casted engine block may be one piece, in accordance with particular embodiments. The cylinder block may be composed of casted iron in particular embodiments. In particular embodiments, the casted engine block assembly includes at least one oil jacket channel including a plurality of curved channel sections. Each of the curved channel section of the plurality of curved channel sections extends about at least a portion of a circumferential portion of a respective cylinder of the plurality of cylinder block openings. The at least one oil jacket channel extends between adjacent cylinder block openings of the plurality of cylinder block openings in the engine block assembly. In particular embodiments, the at least one oil jacket channel includes a first oil jacket channel and a second oil jacket channel. The first oil jacket channel is disposed on a first half of the plurality of cylinder block openings and the second oil jacket channel is disposed on a second half of the plurality of cylinder block openings opposite the first half.

Other various embodiments provide a casted engine block assembly that includes a cylinder block including a plurality of cylinder block openings disposed therein. The engine block assembly also includes a cylinder block flange portion positioned at a top of the cylinder block portion. The cylinder block flange portion is configured for coupling the cylinder block to a cylinder head. The engine block assembly further includes a cylinder block crankcase portion disposed at a base of the cylinder block. The cylinder block includes a plurality of cylinder block walls extending between the cylinder block flange portion and the cylinder block crankcase portion and positioned about the plurality of cylinder block openings. The plurality of cylinder block walls house a plurality of internal channels. The plurality of cylinder walls are formed by cylinder cores having solely internal core prints such that the cylinder block formed thereby is void of one or more holes extending through at least one of the cylinder block walls in the plurality of cylinder block walls from outside of the cylinder block and into an interior volume of the cylinder block.

Other various embodiments provide a method of manufacturing an engine block assembly. The method includes providing a mold for the engine block assembly. The mold includes a plurality of cylinder barrel core sections. Each cylinder barrel core section in the plurality of cylinder barrel core sections includes one or more prints configured to remain within the engine block assembly. The one or more prints extend from each of cylinder barrel core section in the plurality of cylinder barrel core sections and the one or more prints connect the barrel core from which the one or more prints extends to an adjacent cylinder barrel core section. The method also includes casting a molten material in the mold and about the plurality of cylinder barrel core sections such that an engine block is formed having a plurality of cylinder block walls extending between a cylinder block flange portion and a cylinder block crankcase portion. The cylinder block walls of the engine block formed are positioned about a plurality of cylinder and house a plurality of internal channels. The plurality of cylinder block walls are void of one or more holes extending through at least one of the cylinder block walls in the plurality of cylinder block walls from outside of the cylinder block and into an interior volume of the cylinder block.

In particular embodiments, the mold further includes an oil drain core section configured to form a plurality of oil channels extending from the cylinder head flange portion to the crankcase portion within the cylinder walls. In particular embodiments the engine block formed also includes a first plurality of fluid channels extending in a direction having a vertical component from the cylinder head flange portion to the crankcase portion and positioned within the plurality of cylinder walls. In particular embodiments engine block formed may also include a second plurality of fluid channels extending in a direction having a horizontal component between the first plurality of channels such each fluid channel in the first plurality of fluid channels is in fluid communication. The engine block may be cast as one piece in accordance with particular embodiments. In particular embodiments, the plurality of cylinder block openings are disposed in a single line. In particular embodiments, the plurality of cylinder block openings are disposed in a plurality of lines. In particular embodiments, the molten metal is molten iron. The mold for the engine block assembly is composed of sand, in accordance with particular embodiments. In particular embodiments, the method may forming at least one oil jacket channel in the engine block such that the at least one oil jacket channel includes a plurality of curved channel sections. Each curved channel section in the plurality of curved channel sections extends about at least a portion of a circumferential portion of a respective cylinder in the plurality of cylinder block openings. The at least one oil jacket channel extends between adjacent cylinder block openings of the plurality of cylinder block openings in the engine block.

The inventors have appreciated that the implementation and use of various embodiments may result in beneficial engine blocks, components and methods of forming engine blocks which may be implemented in a manner that creates units having increased structural integrity while permitting efficient and effective distribution of fluids such as lubricating oils and coolants through an engine block, thereby improving the manufacturing process through the reduction of manufacturing time and costs. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive systems, and methods of forming an engine block. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figures 1A, 1B, 1C:
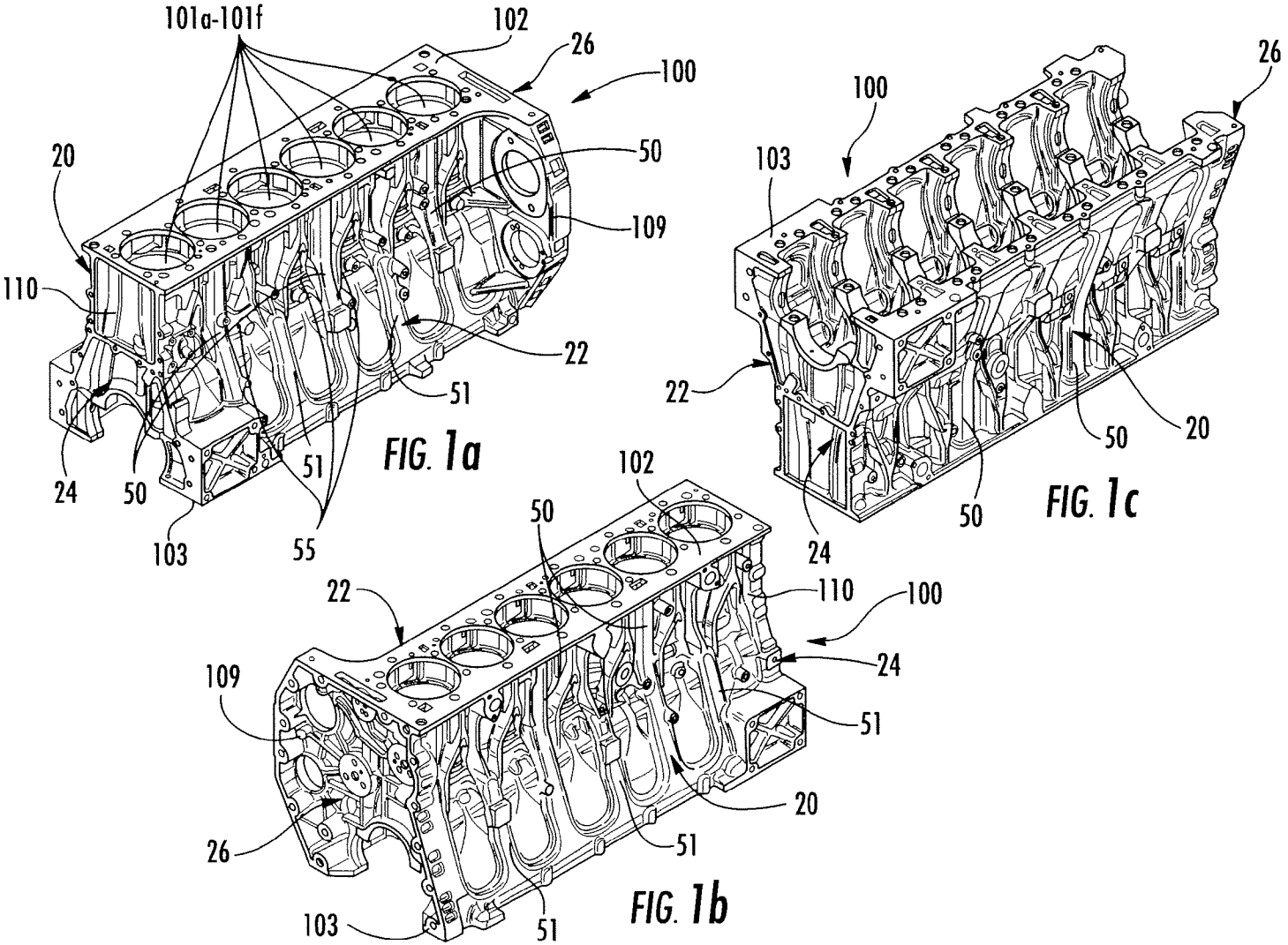
FIGS. 1*a*-1*c* are different perspective views of an engine block formed in accordance with exemplary embodiments.
Figure 3:
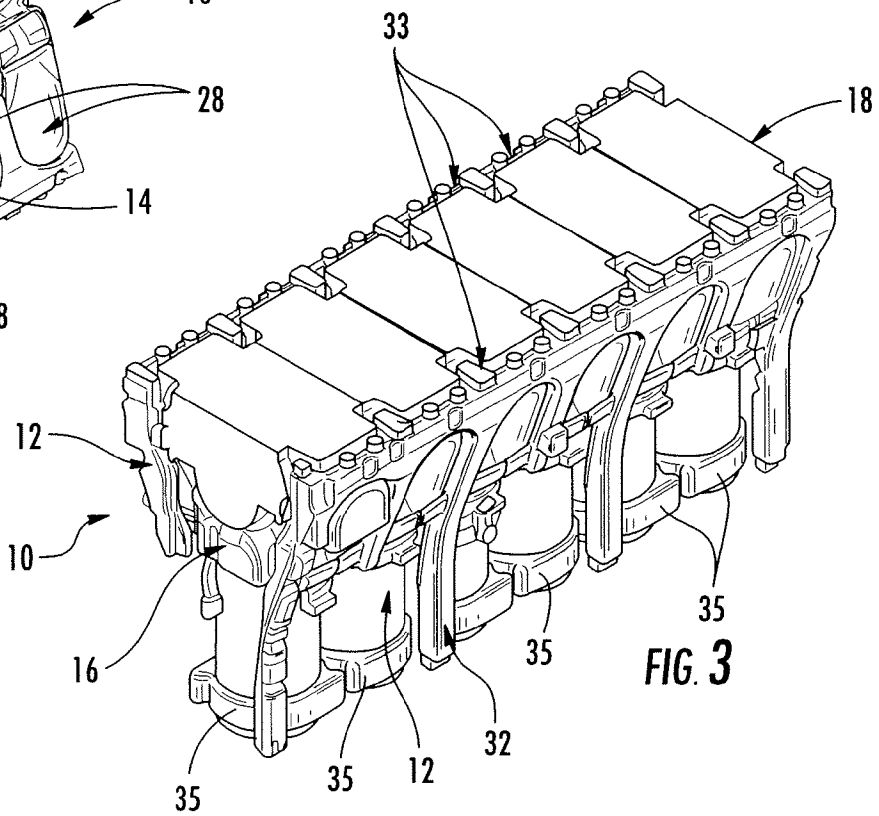
FIG. 3 is a bottom perspective view of the engine core assembly of FIG. 2.
Figure 2:
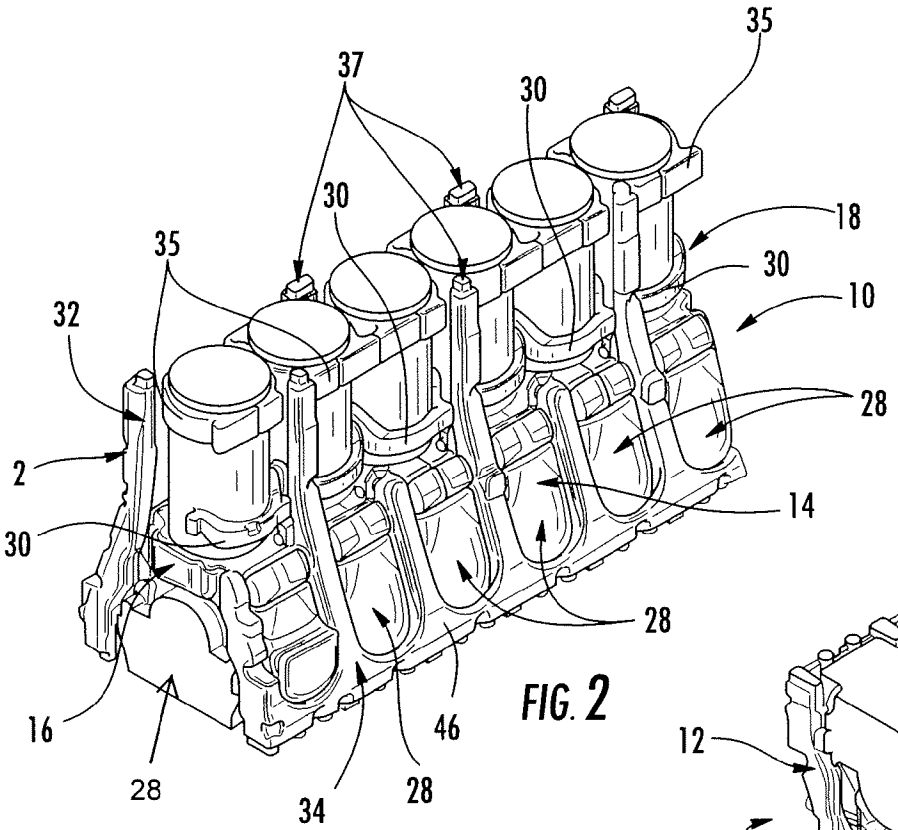
FIG. 2 is a top perspective view of an engine core assembly including the barrel core, water jacket core, oil jacket core, and oil drain core in accordance with exemplary embodiments.
Figure 4:
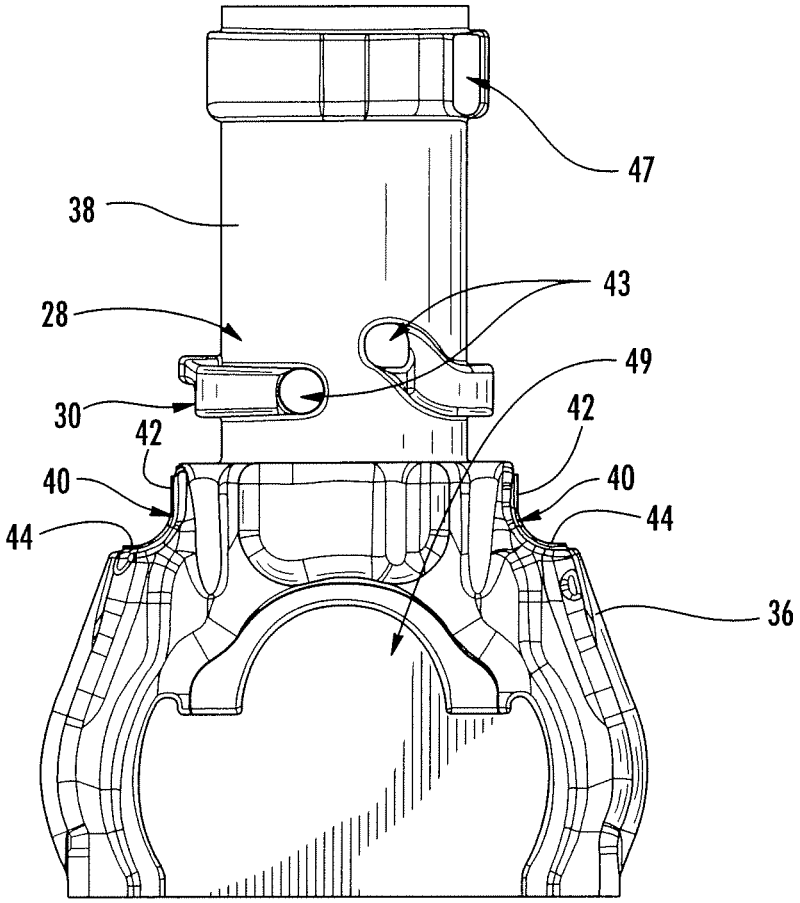
FIGS. 4 and 5 are end views of the engine core assembly of FIG. 2 without the oil drain core.
Figure 6:
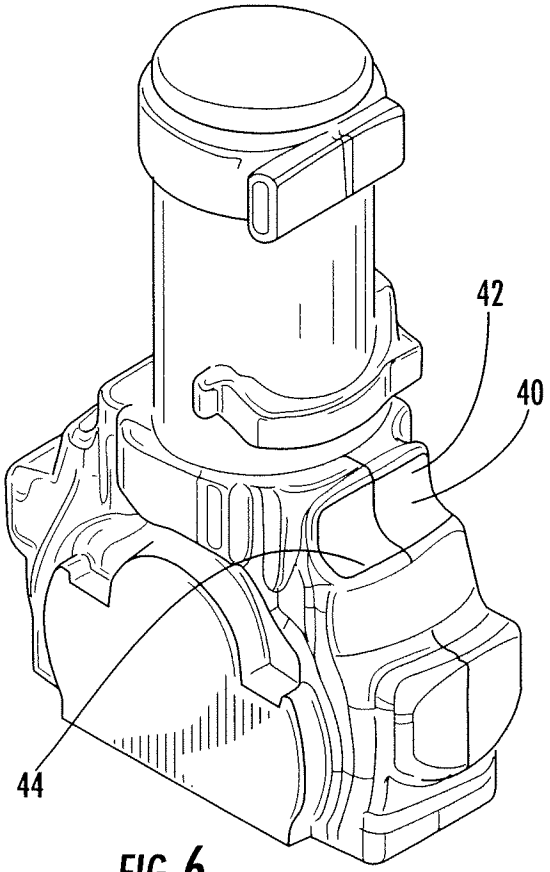
FIG. 6 is a perspective view of the barrel core, water jacket core, oil jacket core, and oil drain core associated with one cylinder of an engine block formed by engine core assembly of FIG. 2.
Figure 5:
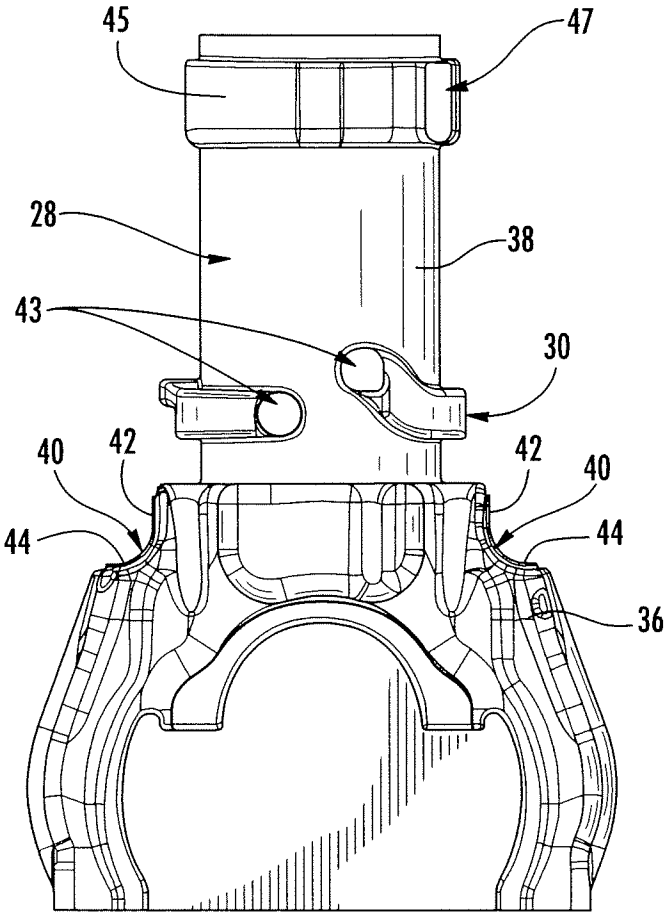
Figure 7:
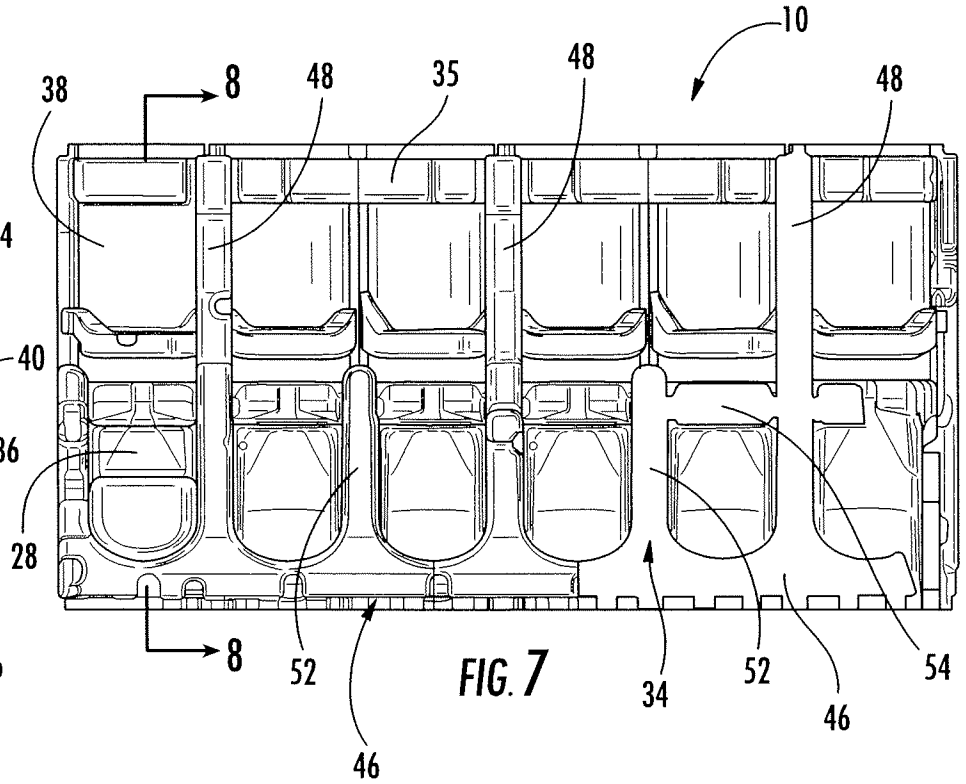
FIG. 7 is a side view of the engine core assembly of FIG. 2.
Figure 8:
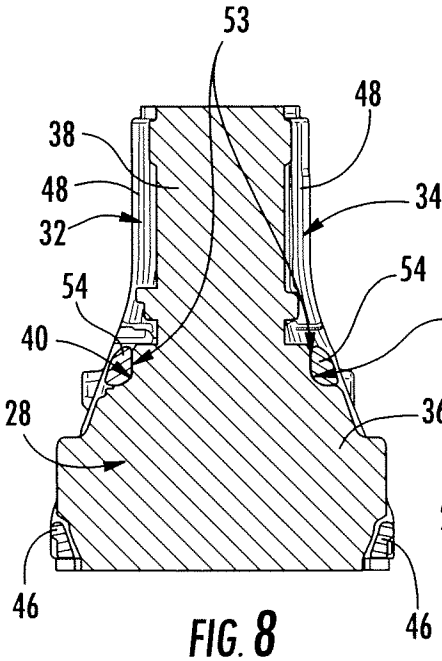
FIG. 8 is a cross-sectional view of the engine core assembly of FIG. 7 taken along plane 8-8.
Figure 9:
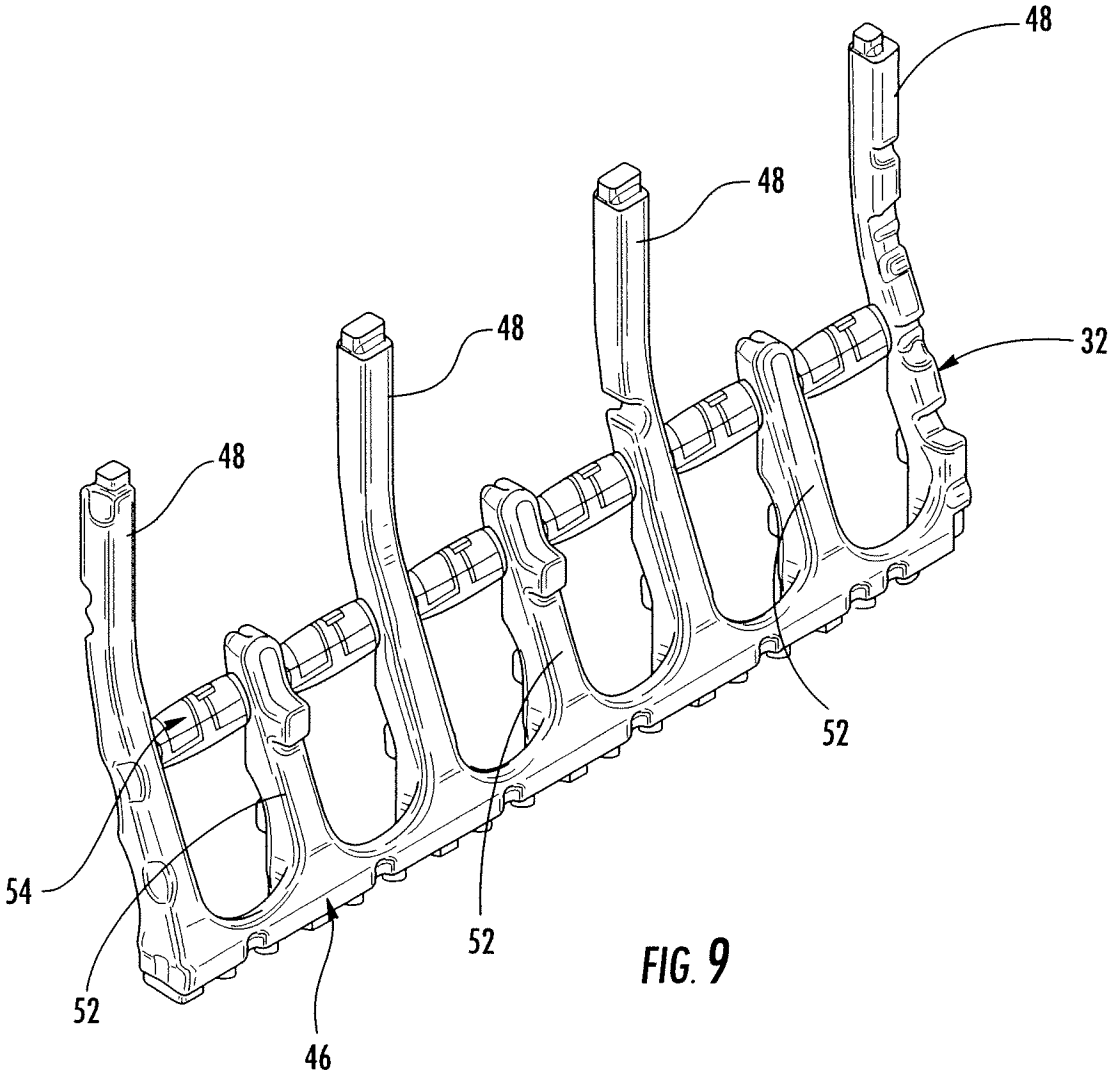
FIG. 9 is a perspective view of the oil drain core of FIG. 2.

FIGS. 1*a*-1*c* provide various perspective views of a casted engine block assembly formed in accordance with exemplary embodiments. More specifically, FIG. 1*a* illustrates a top perspective view of an engine block assembly 100. FIG. 1*b* illustrates another top perspective view of the engine block assembly 100 rotated 180 degrees. FIG. 1*c* illustrates a bottom perspective view of the engine block assembly 100. The engine block assembly 100 includes a cylinder block portion 110 defining a plurality of cylinder block openings 101*a*-101*f* which house cylinder barrel core components (not shown) in accordance with exemplary embodiments. In the illustrated embodiment, the engine block assembly 100 includes 6 cylinder block openings disposed in an inline configuration. In accordance with various embodiments, an engine block assembly may include more than 6 cylinder block openings or less than 6 cylinder block openings. An engine block assembly in accordance with particular embodiments may include a plurality of cylinder block openings disposed in more than one line, such as cylinder block openings disposed in a "V" configuration.

The engine block assembly 100 includes a cylinder block flange portion 102 positioned at a top of the cylinder block portion 110. The cylinder block flange portion 102 includes a platform or ledge extending laterally about the cylinder block openings 101*a*-101*f*. The cylinder block flange portion 102 may include one or more apertures disposed therein configured to receive one or more fastener for coupling a cylinder head to the engine block assembly 100.

The engine block assembly 100 also includes a crankcase portion 103 disposed at a base of the cylinder block portion 110. The crankcase portion 103 is configured for coupling the engine block assembly 100 to a crankcase and is configured for housing a crankshaft for coupling to pistons disposed in the cylinder block openings 101*a*-101*f*. The cylinder block assembly may include a bearing support such as bearing support structure 108 coupled to the cylinder block portion 110.

The cylinder block portion 110 includes a plurality of cylinder block walls 104-107 disposed at sides 20, 22 and ends 24, 26. The cylinder block walls 104-107 extend between the cylinder block flange portion 102 and the cylinder block crankcase portion 103 and are positioned about the cylinder block openings 101*a*-101*f*. The cylinder block walls 104-107 house a plurality of internal channels, which may include, but are not limited to, oil drain channels 51 and oil jacket channel 55. The cylinder block walls 104-107 are generally formed from molds composed of core components having no external prints, as discussed further herein. Accordingly, the cylinder block walls 104-107 are formed without any enclosed openings (e.g. where the opening is fully surrounded by a portion of the wall) that extend through at least one of the cylinder block walls 104-107. Providing the cylinder block walls 104-107 of the engine block assembly 100, without any such openings while still providing casted fluid channels within the engine block assembly 100 permits the engine block assembly 100 to be casted as a one piece system having increased levels of structural rigidity and efficient, effective means of transmitting fluids such as oil or coolant through the cylinder block.

In accordance with particular embodiments, the engine block assembly 100 may be casted through implementation of an engine core assembly mold, such as engine core assembly mold 10 exemplarily illustrated in FIGS. 2-9.

The engine block assembly 100 may be formed as one piece by a casting method, such as a sand casting method in accordance with exemplary embodiments. In connection with casting the engine block assembly 100, a mold, such as the engine core assembly mold 10 is created to provide the engine block assembly 100 with the appropriate shapes and features. As discussed further herein, the engine core assembly mold 10 may be composed of one or more parts connected or integrally formed. The engine core assembly mold 10 permits some potential issues that may be associated with having external casting openings that result in an engine block assembly requiring additional machining and parts to seal. The engine core assembly mold 10 avoids the use of protrusions or prints extending from the sides 12, 14 and from the ends 16, 18 of the engine core assembly, thereby avoiding openings in the sides 20, 22, and the ends 24, 26 of the engine block assembly 100. Therefore, the ends and sides of the engine core assembly mold 10 are free from protrusion of sufficient size and dimensions to cause external openings in the engine end and side walls, and the end and side surfaces of the engine block assembly 100 are free from external openings due to the core assembly. Additionally, features typically machined into the block and head are incorporated into the casting, thereby reducing machining costs. For example, the core assembly mold 10 may include features for creating an oil jacket channel in the mold, coolant channels, or fluid channels.

In the exemplary embodiment illustrated in FIGS. 2-9, the core assembly mold 10 includes a plurality of cylinder barrel cores 28, oil jacket cores 30 integrally formed on, or mounted on, the respective cylinder barrel core 28, a first oil drain core 32 positioned on one side of the cylinder barrel cores 28, and a second oil drain core 34 positioned on an opposite side of the cylinder barrel cores 28 from the first oil drain core 32. The cylinder barrel cores 28 correspond in number to the number of cylinder block openings in the engine. The core assembly 10 may also include a coolant jacket core or cores 35 integrally formed on, or mounted on, the cylinder barrel cores 28 adjacent a top end of the cylinder barrel cores 28. The first oil drain core 32 is supported by, and directly abuts, the cylinder barrel core 28 against the force of gravity such that the first oil drain core 32 is stabilized in position throughout the casting process. The first oil drain core 32 may include core prints 33 that extend to a pan rail for oil drain back and core prints 37 that extend to a head deck for oil drain back.

Specifically, and as shown in FIGS. 4-8, each of the cylinder barrel cores 28 includes a lower portion 36 and an upper cylindrical portion 38. A shoulder 40 is formed on an upper section of the lower portion 36 on each side of each of the cylinder barrel cores 28 to provide support to the first and the second oil drain cores 32 and 34 respectively. Each of the shoulders 40 includes a first support surface 42 extending longitudinally along the axis of each of the upper cylindrical portion 38, and a second support surface 44 extending transverse to the first support surface 42. The first support surface 42 is positioned longitudinally between the second support surface 44 and oil jacket cores 30 31. The oil jacket cores 30, 31 may be disposed on opposite sides of the upper cylindrical portion 38. Oil jacket cores 30, 31 may include curved protrusions protruding radially outward from cylinder wall of the cylinder barrel core 28 and extending about at least a portion of a circumferential portion of the cylinder and configured to form curved channel sections of oil jacket channel 55. The respective oil jacket cores on the adjacent cylinder barrel cores 28 may connect via core prints 43 such that the oil jacket channel 55 is formed as a continuous channel extending through the engine block assembly 100. The cylinder barrel cores 28 may also include a curved protrusion 45 having core print 47 and protruding radially outward from the cylinder wall of the cylinder barrel core 28 and extending about at least a portion of a circumferential portion of the cylinder and configured to form a coolant flow passage. The cylinder barrel cores 28 may also include core print 49 near the cylinder block crankcase portion of the cylinder barrel core 28. Core prints such as core prints 43, 47, and 49 may connect to adjacent and corresponding core prints on adjacent cylinder barrel cores 28 to ensure dimensional stability of the core assembly mold 10 and, as demonstrated, may perform the additional function of forming a connection portion of a channel such as an oil jacket or coolant jacket.

Each of the first and second oil drain cores 32 and 34 respectively is formed as a ladder frame core including a base portion 46 extending longitudinally along the base of the assembly, and multiple vertical members 48 extending from the base portion 46 to form hollow bulkheads 50 in the casted engine (FIGS. 1*a*-1*c*) for draining oil through the block from the top end to the bottom end. Each of the first and second oil drain cores 32 and 34 respectively also includes a longitudinal support 54 extending longitudinally along the assembly to connect to the multiple verticals members 48. Each of the first and second oil drain cores 32 and 34 respectively may also include short supports 52 extending from the base portion 46 along the lower portion 36 to terminate adjacent an upper portion of the lower portion 36. Each longitudinal support 54 also connects to each of the short support 52 on the respective side of the assembly. It should be noted that the longitudinal support 54 may be formed via single elongated piece connected to the other supports, as separate pieces extending between the supports, or integrally formed with the supports. Likewise, base the portion 46 may be formed as one piece, or as separate pieces, for example with each piece being integrally formed on the lower ends of each vertical member supports and short supports and then fixedly connected to form the integral oil drain core. Thus, each core can be made as a single larger core or may be comprised of smaller cores connected together.

Each of the first and second oil drain cores 32 and 34 respectively is supported on the shoulder 40 to stabilize the drain core during casting. Specifically, longitudinal support 54 is positioned against each of the shoulders 40 via lateral oil drain core prints 53, causing each of the cylinder barrel cores 28 to provide both lateral and vertical support to each of the first and second oil drain cores 32 and 34 respectively, which support may be achieved without external breakouts through cylinder block walls of the cylinder block formed by the core assembly mold. Each of the cylinder barrel cores 28 abuts the first support surface 42 and second support surface 44 of each of the shoulders 40 to laterally and vertically support the barrel core without the need for external prints. All the cores are then connected with fasteners and/or adhesive.

The above approach allows for cored water jacket, cored lubrication circuits, and cored block skirts with less machining operations on the finished block/head, less assembled parts, increased rigidity, and decreased casting mass, without costly external openings. The assembly and method provides a strategic advantage by reducing material and machining costs associated with making an engine block.

Figure 10:
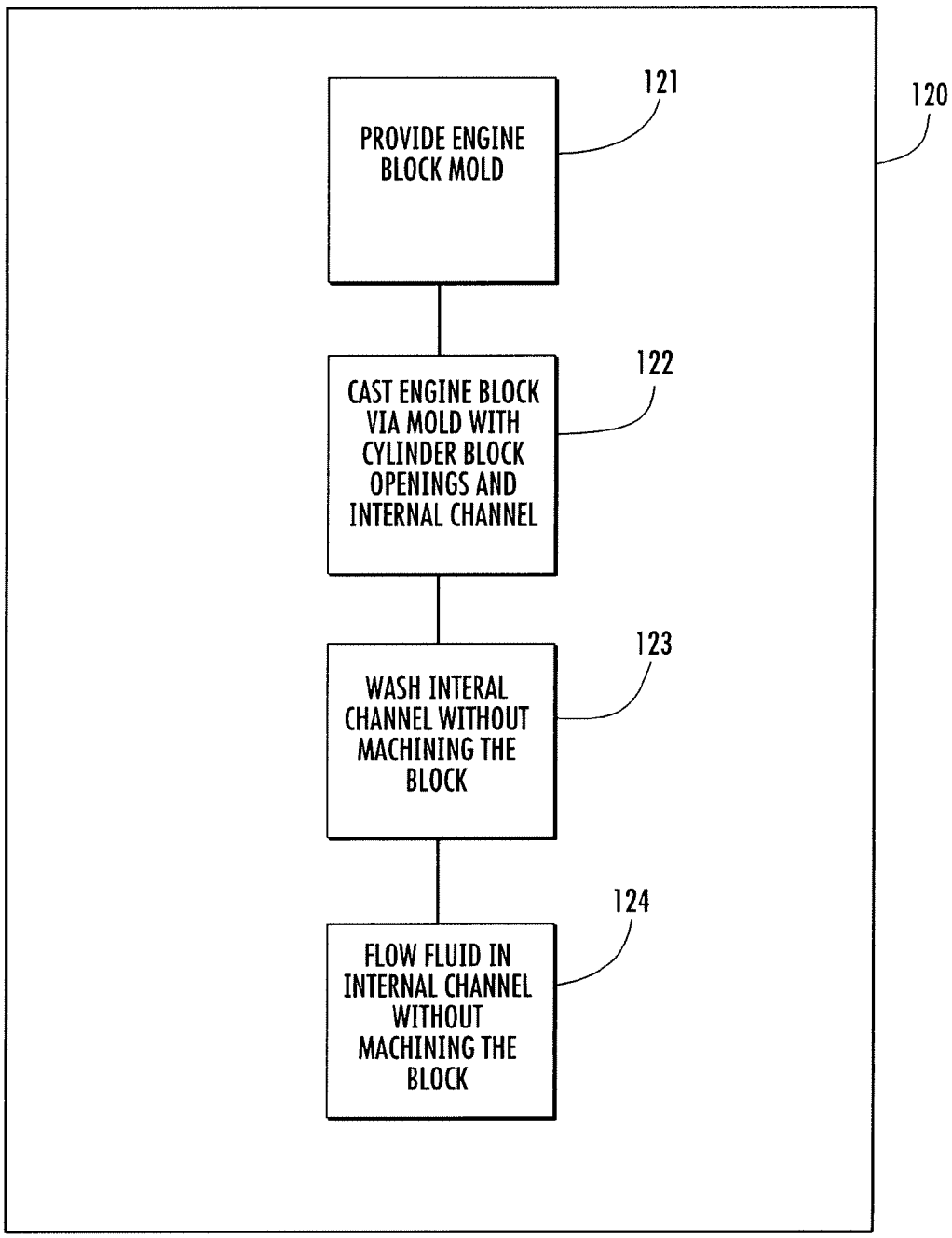
FIG. 10 shows a flow chart related to methods of manufacturing an engine assembly in accordance with exemplary embodiments.

FIG. 10 shows a flow chart related to methods of manufacturing an engine assembly in accordance with exemplary embodiments. Flow chart 120 demonstrates processes that may be implemented to cast an engine block, such as the engine block assembly 100. In process 121, an engine block mold is provided. The mold includes a core assembly, such as the engine core assembly mold 10. In process 122, the engine block is cast via the mold using a molten material poured in the mold. The engine block is casted in the process 122 to include a plurality of cylinder block walls extending between a cylinder block flange portion and a cylinder block crankcase portion. The cylinder block walls are positioned about a plurality of cylinder block openings. The plurality of cylinder block walls house at least one internal channel extending about at least a portion of a circumferential portion of each cylinder block opening. In accordance with exemplary embodiments, the at least one internal channel may be formed by at least one curved protrusions and the one or more core prints extending from cylinder barrel core sections of the mold. In accordance with some embodiments, manufacturing the engine block may include process 123, which includes washing the internal channel formed by the process 122 without machining the block. The manufacturing of the engine block may include process 124, which includes flowing fluid in the internal channel formed by the process 122 without machining the block.

As utilized herein, the terms "approximately," "about," "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, describes techniques, or the like, this application controls.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A method of casting an engine block, the method comprising:

providing a mold for the engine block, the mold including a plurality of cylinder barrel core sections, each cylinder barrel core section of the plurality of cylinder barrel core sections including at least one curved protrusion protruding radially outward from a cylinder barrel core section wall, formed directly on and extending circumferentially about at least a portion of a circumferential portion of the cylinder barrel core section, the at least one curved protrusion including one or more core prints extending therefrom, the one or more core prints connecting the at least one curved protrusion from which the one or more core prints extends to an adjacent cylinder barrel core section in the plurality of cylinder barrel core sections; and casting a molten material in the mold and about the plurality of cylinder barrel core sections such that an engine block is formed having a plurality of cylinder block walls extending between a cylinder block flange portion and a cylinder block crankcase portion, the cylinder block walls positioned about a plurality of cylinder block openings, the plurality of cylinder block walls housing at least one internal channel extending about at least a portion of a circumferential portion of each cylinder block opening, the at least one internal channel formed by the at least one curved protrusions and the one or more core prints.

2. A method of casting an engine block according to claim 1, further comprising removing the plurality of cylinder barrel core sections from the engine block before any machining of the engine block.

3. A method of casting an engine block according to claim 2, wherein machining includes drilling.

4. A method of casting an engine block according to claim 2, wherein the plurality of cylinder barrel core sections are removed from the engine block via a washing fluid.

5. A method of casting an engine block according to claim 2, further comprising transmitting a coolant fluid through the at least one internal channel extending about at least a portion of a circumferential portion of each cylinder block opening without machining through cylinder block walls into the at least one internal channel.

6. A method of casting an engine block according to claim 2, further comprising transmitting a lubricating fluid through the at least one internal channel extending about at least a portion of a circumferential portion of each cylinder block opening without machining through cylinder block walls into the at least one internal channel.

7. A method of casting an engine block according to claim 1, further comprising inserting a cylinder liner into each cylinder block opening in the plurality of cylinder block openings.

8. A method of casting an engine block according to claim 1, wherein at least one of the cylinder barrel core sections includes at least one core print extending out from at least one cylinder barrel core section in the plurality of cylinder barrel core sections such that a corresponding opening is formed in at least one of the cylinder block walls in the plurality of cylinder block walls extending between the cylinder block flange portion and a cylinder block crankcase portion.

9. A method of casting an engine block according to claim 8, further comprising positioning at least a portion of a functional engine component in the corresponding opening.

10. A method of casting an engine block according to claim 8, further comprising washing the at least one internal channel extending about at least a portion of a circumferential portion of each cylinder block opening via washing fluid entering the engine block via the corresponding opening.

11. A method of casting an engine block, the method comprising:

casting a cylinder block portion including a plurality of cylinder block openings disposed therein;

casting a cylinder block flange portion positioned at a top of the cylinder block portion, the cylinder block flange portion configured for coupling the cylinder block to a cylinder head; and casting a cylinder block crankcase portion disposed at a base of the cylinder block, the cylinder block portion casted to include:

a plurality of cylinder block walls extending between the cylinder block flange portion and the cylinder block crankcase portion and positioned about the plurality of cylinder block openings, and at least one internal channel formed directly on and extending circumferentially about at least a portion of a circumferential portion of each cylinder block opening within the plurality of cylinder block walls, the at least one internal channel formed by a plurality of core sections having one or more core prints connecting the core sections;

washing at least one internal channel without machining the block; and causing coolant to flow within the at least one internal channel without machining.

12. A method of manufacturing an engine block assembly, the method comprising providing a mold for the engine block assembly, the mold including a plurality of cylinder barrel core sections, each cylinder barrel core section of the plurality of cylinder barrel core sections including one or more prints configured to remain within the engine block assembly, the one or more prints extending circumferentially from each cylinder barrel core section in the plurality of cylinder barrel core sections and the one or more prints connecting the cylinder barrel core from which the one or more prints extends to an adjacent cylinder barrel core section; and casting a molten material in the mold and about the plurality of cylinder barrel core sections such that an engine block is formed having a plurality of cylinder block walls extending between a cylinder block flange portion and a cylinder block crankcase portion, the cylinder block walls positioned about a plurality of cylinder block openings, the plurality of cylinder block walls housing a plurality of internal channels, wherein the plurality of cylinder block walls void of one or more holes extend through at least one of the cylinder block walls in the plurality of cylinder block walls from outside of the cylinder block and into an interior volume of the cylinder block.

13. A method of manufacturing an engine block assembly according to claim 12, wherein the mold further includes an oil drain core section configured to form a plurality of oil channels extending from the cylinder head flange portion to the crankcase portion within the cylinder walls.

14. A method of manufacturing an engine block assembly according to claim 12, wherein the formed engine block further comprises a first plurality of fluid channels extending in a direction having a vertical component from the cylinder head flange portion to the crankcase portion and positioned within the plurality of cylinder walls.

15. A method of manufacturing an engine block assembly according to claim 12, wherein the formed engine block further comprises a second plurality of fluid channels extending in a direction having a horizontal component between the first plurality of channels such that each fluid channel in the first plurality of fluid channels is in fluid communication.

16. A method of manufacturing an engine block assembly according to claim 12, wherein the engine block is cast as one piece.

17. A method of manufacturing an engine block assembly according to claim 12, further comprising forming at least one oil jacket channel in the engine block such that the at least one oil jacket channel includes a plurality of curved channel sections, each curved channel section in the plurality of curved channel sections extending about at least a portion of a circumferential portion of a respective cylinder in the plurality of cylinder block openings, wherein the at least one oil jacket channel extends between adjacent cylinder block openings of the plurality of cylinder block openings in the engine block.

* * * * *